US005413905A

United States Patent [19]

Lok et al.

[11] Patent Number: 5,413,905

[45] Date of Patent: May 9, 1995

[54] PHOTOGRAPHIC SENSITIVITY INCREASING ALKYNYLAMINE COMPOUNDS AND PHOTOGRAPHIC ELEMENTS

[75] Inventors: Roger Lok; Carl R. Preddy; John W. Harder, all of Rochester, N.Y.

[73] Assignee: Eastman Kodak Company, Rochester, N.Y.

[21] Appl. No.: 169,833

[22] Filed: Dec. 16, 1993

[51] Int. Cl.[6] ..... G03C 1/005; G03C 1/08

[52] U.S. Cl. ..... 430/600; 430/613; 430/614; 430/569

[58] Field of Search ..... 430/600, 613, 569, 614

[56] References Cited

U.S. PATENT DOCUMENTS

| | | | |
|---|---|---|---|
| T103,803 | 1/1984 | Lok et al. . | |
| T104,802 | 11/1984 | Parton . | |
| T104,903 | 12/1984 | Lok et al. . | |
| 2,490,745 | 12/1949 | Carroll . | |
| 3,782,959 | 1/1974 | Bigelow | 96/107 |
| 4,150,993 | 4/1979 | Suga et al. . | |
| 4,378,426 | 3/1983 | Lok et al. | 430/505 |
| 4,451,557 | 5/1984 | Lok et al. | 430/505 |
| 4,576,905 | 3/1986 | Gunther et al. | 430/401 |
| 4,847,179 | 7/1989 | Boie et al. | 430/613 |
| 5,236,815 | 8/1993 | Dewanckele et al. | 430/613 |

FOREIGN PATENT DOCUMENTS

| | | |
|---|---|---|
| 0369424 | 5/1990 | European Pat. Off. . |
| 0369491 | 5/1990 | European Pat. Off. . |

*Primary Examiner*—Thorl Chea
*Attorney, Agent, or Firm*—Peter C. Cody

[57] ABSTRACT

The present invention relates to water soluble photographic sensitivity increasing alkynylamine compounds. It also relates to photographic elements containing such compounds.

18 Claims, No Drawings

PHOTOGRAPHIC SENSITIVITY INCREASING ALKYNYLAMINE COMPOUNDS AND PHOTOGRAPHIC ELEMENTS

FIELD OF THE INVENTION

This invention relates to water soluble photographic sensitivity increasing alkynylamine compounds. It also relates to photographic elements containing such compounds.

BACKGROUND OF THE INVENTION

The sensitivity (also referred to as "speed") of a silver halide emulsion layer in a photographic element is generally considered as the density of a visible image formed upon exposure and subsequent development, relative to a given level of exposure. It is known to improve a silver halide emulsion layer's sensitivity by incorporating within such an emulsion various non-silver or non-halide compounds. Collectively (and befittingly), these compounds are termed sensitizers.

Known sensitizers are gold and sulfur compounds. Both are quite prevalent in the art and both are thought to enhance emulsion sensitivity by forming electron traps or photohole traps on the surfaces of silver halide crystals.

Other sensitizers include transition metal salts such as platinum salts. However, these sensitizers suffer the disadvantage of having their activity strongly retarded by the gelatin in which the silver halide grains of an emulsion are dispersed. Iridium salts and complex ions of rhodium, osmium, and ruthenium have also been used as sensitizers. The overall effect of these metals on sensitivity appears to be dependent upon their valence state.

Reduction sensitization is another means by which sensitivity enhancement has been obtained. Known reducing agents include stannous chloride, ascorbic acid (as in European Patent Applications 0369491 and 0369424) and dimethylamine borane (U.S. Pat. Nos. 4,150,093 and 3,782,959).

The use of sensitizers as described above often causes an indiscriminate, and undesirable, reduction of silver ions to silver atoms. The silver atoms give rise during development to a generally or locally developed density that is not associated with the action of the image forming exposure. This density is typically termed fog and, for negative elements, it is best measured as the minimum density on the element's D-Log E curve (Dmin); for positive (reversal) elements, it is best measured as the percent of $D_{min}$ relative to $D_{max}$ in a standard 6 minute E6 rehalogenation process.

In sensitized photographic silver halide elements, fog formation is often controlled by the addition of oxidants which impede the reduction of silver ions to metallic silver (or reverse the reaction). Addition of such oxidants, however, requires that a balance be struck between the desensitization effects of the oxidants and the sensitization effects of the sensitizer, a balance which is difficult to attain.

In photographic silver halide emulsions, it is also known that when certain types of compounds are added to a photographic silver halide emulsion they must be added while dissolved in an organic solvent. Specific examples of compounds requiring dissolution in an organic solvent include sensitizing dyes and those compounds described in U.S. Pat. Nos. 4,451,557 and 4,378,426.

U.S. Pat. Nos. 4,451,557 and 4,378,426 disclose a group of aminobenzoxazole compounds that have been found useful in reducing image fading when incorporated into photographic emulsions as post-precipitation addenda. Some speed increase is also observed. As noted, these compounds require dissolution in an organic solvent prior to incorporation into a silver halide emulsion.

Generally, the organic solvent utilized in the above-described procedures is methanol. Methanol exhibits substantial volatility and thus presents significant safety and environmental risks, particularly when used in open reactors during production scale manufacturing. Furthermore, because the precipitation of a silver halide emulsion generally occurs in an aqueous environment (whether such emulsion is formed from single jet, double jet, or other known procedure) addition of non-aqueous soluble sensitizers during precipitation must require an additional manufacturing step. This results in a loss of manufacturing flexibility and could also result in an increase in production costs.

It is therefore desired to provide a class of compounds capable of improving the sensitivity of a photographic light sensitive element, wherein such compounds may be added to the photographic element in the absence of substantial amounts of volatile organic solvents. It is further desired to provide a photographic light sensitive element which exhibits increased sensitivity, and which does so without requiring the addition of oxidants to control fog formation.

SUMMARY OF THE INVENTION

It is thus an object of this invention to provide a photographic light sensitive element which exhibits increased sensitivity.

It is a further object of this invention to provide a class of compounds capable of improving the sensitivity of a photographic light sensitive element, wherein such compounds may be added to the photographic element in the absence of substantial amounts of volatile organic solvents.

These and other objects of the invention are accomplished by the present invention which provides a photographic element comprising a silver halide emulsion and an alkynylamine compound, wherein the alkynylamine compound further comprises a water solubilizing group.

In a preferred embodiment of the invention, the alkynylamine compound is the sodium salt of 2-(2-butynylamino)-5-benzoxazolecarboxylic acid. Preferably, it is added to the silver halide emulsion during precipitation of the emulsion's silver halide grains.

DETAILED DESCRIPTION OF THE INVENTION

The ability of certain alkynylamines, namely those represented by the structure below, to produce increases in speed and latent image stability when incorporated into photographic emulsions as grain surface modifiers (post-precipitation) has been described in prior U.S. Pat. Nos. 4,378,426 and 4,451,557.

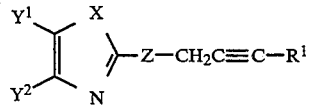

wherein:

X is —O—, —S—, —Se—, or

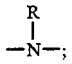

$y^1$ and $y^2$ individually represent hydrogen or an aromatic nucleus or together represent atoms completing a fused aromatic nucleus;

Z is

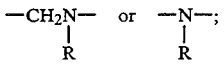

R is hydrogen or lower alkyl of from 1 to 5 carbon atoms; and $R^1$ is hydrogen or methyl.

In this invention, it has been discovered that structurally modifying the above compounds to be substituted with a water solubilizing group does not adversely affect the compounds' ability to improve the sensitivity of a photographic element. Furthermore, improved sensitivity can be accomplished without substantially increasing fog.

The water soluble alkynylamine compounds of the present invention also allow film to be sensitized in the absence of substantial amounts of volatile organic solvents. This allows for a safer and cleaner construction of films.

The present invention concerns photographic elements comprising a compound of the formula

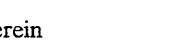

wherein $R^3$ represents a hydrogen atom, aliphatic, carbocyclic (including aryl), or heterocyclic group, which may be substituted or unsubstituted. $R^3$ may also be or contain a water solubilizing group as defined below. Preferably, though, $R^3$ is a non-water solubilizing group and is other than hydrogen. More preferably, it is an alkyl or hydroxyalkyl group having 1 to 20 carbon atoms. And optimally, it is a methyl group.

Examples of suitable aliphatic groups include methyl, ethyl, propyl, butyl, pentyl, hexyl, octyl, ethylhexyl, decyl, dodecyl, hexadecyl, octadecyl, isopropyl, t-butyl, butenyl, propynyl, and butynyl.

Examples of suitable carbocyclic groups are phenyl, tolyl, naphthyl, cyclohexyl, cycloheptatrienyl, cyclooctatrienyl, cyclononatrienyl, p-methoxyphenyl, and p-chlorophenyl.

Examples of suitable heterocyclic groups are pyrrole, furan, tetrahydrofuran, pyridine, picoline, piperidine, morpholine, pyrrolidine, thiophene, oxazole, thiazole, imidazole, selenazole, tellurazole, triazole, tetrazole, and oxadiazole.

The substituent represented by Y above is preferably a nitrogen containing heterocycle (including a heterocyclic ring system of two or more fused rings). Thus, Y includes substituted and unsubstituted oxazoles, thiazoles, selenazoles, oxadiazoles, thiadiazoles, triazoles, tetrazoles, pyrimidines, pyrroles, pyridines, quinolines, and benzimidazoles. Preferably, Y is a nitrogen containing azole.

Groups suitable for substitution on Y (as well as $R^3$) include alkyl groups (for example, methyl, ethyl, hexyl), fluoroalkyl groups (for example, trifluoromethyl), alkoxy groups (for example, methoxy, ethoxy, octyloxy), aryl groups (for example, phenyl, naphthyl, tolyl), hydroxy groups, halogen groups, aryloxy groups (for example, phenoxy), alkylthio groups (for example, methylthio, butylthio), arylthio groups (for example, phenylthio), acyl groups (for example, acetyl, propionyl, butyryl, valeryl), sulfonyl groups (for example, methylsulfonyl, phenylsulfonyl), acylamino groups, sulfonylamino groups, acyloxy groups (for example, acetoxy, benzoxy), carboxy groups, cyano groups, sulfo groups, and amino groups.

Y can be substituted with a water solubilizing group. By water solubilizing group it is meant a group which allows the alkynylamine compounds of the present invention to be soluble in water thus enabling such compounds to applied to the emulsion in an aqueous solution. The water solubilizing group should be sufficiently soluble as to allow a photographically effective amount of the alkynylamine compounds to be applied to the silver halide grains of the emulsion. It may, for example, be such as to make the alkynylamine soluble at greater than or equal to 0.1 grams per liter of water. A photographically effective amount is defined below.

Representative examples of water solubilizing groups include carboxy, carboxyalkyl, sulfo, sulfoalkyl, phosphato, phosphatoalkyl, phosphono, phosphonoalkyl, carbonamido, sulfonamido, hydroxy, and salts thereof. Preferably, the water solubilizing group is a carboxy or sulfo group, or salt thereof. Optimally, it is the sodium or potassium salt of a carboxy group.

The above described water solubilizing groups may be substituted as, or on, the $R^3$ group above. This may be in addition to, or in place of, the water solubilizing groups substituted on Y. In essence, the water solubilizing groups may be substituted anywhere on the alkynylamine compound, though it is preferable that they not be substituted on the nitrogen atom of the amine group. Optimally, the alkynylamine compounds of the present invention have one water solubilizing group substituted on the heterocyclic moiety represented by Y in the structure above.

Preferred alkynylamines are also ones in which the alkynylamine is substituted on the carbon of a N=C moiety as shown in the following structure:

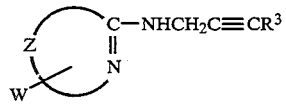

wherein Z represents atoms necessary to complete a five to nine-membered heterocyclic ring system, preferably a nine-membered fused heteroaromatic ring; W is a water solubilizing group; and $R^3$ is defined as above.

The most preferred alkynylamines contain benzoxazole, benzoselenazole, or benzothiazole moieties, and are represented by the following structure:

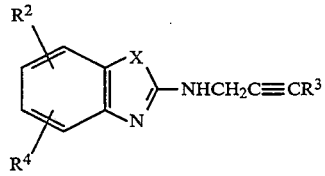

wherein X represents a substituted or unsubstituted nitrogen; or oxygen, sulfur, or selenium, preferably oxygen; $R^3$ is as defined above; $R^2$ and $R^4$ independently represent hydrogen, a halogen, a substituted or unsubstituted alkyl or alkoxy group, preferably one having from 1 to 10 carbon atoms, or a water solubilizing group; and wherein at least one of $R^2$ and $R^4$ is a water solubilizing group.

In the alkynylamine compounds described above, $R^2$ and $R^4$ are preferably in the 6 and 5 positions respectively.

Specific compounds contemplated to be within the scope of the present invention include:

Compound A:

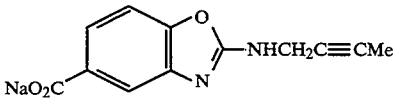

Compound B:

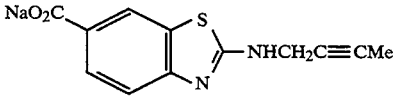

Compound C:

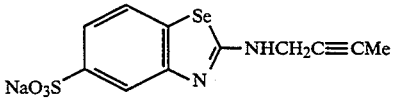

Compound D:

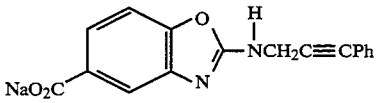

Compound E:

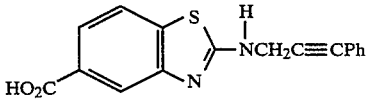

Compound F:

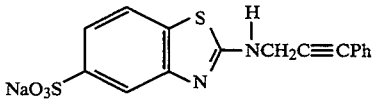

Compound G:

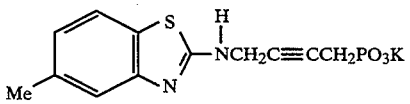

Compound H:

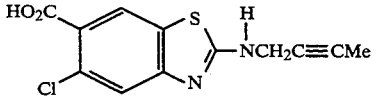

Compound I:

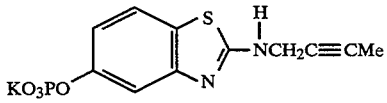

Compound J:

-continued

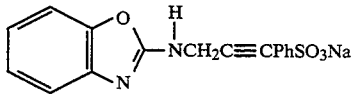

Compound K:

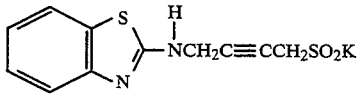

The alkynylamine compounds are preferably incorporated into the photographic emulsion in an amount between about 0.001 and about 5.0 millimoles per mole of silver. A more preferred level of incorporated alkynylamine is between about 0.002 and about 1 millimole per mole of silver; and an even more preferred level is between about 0.005 and about 0.1 millimole per mole of silver.

The preferred levels of alkynylamine can also vary depending upon whether it is added to the photographic element during silver halide precipitation (dopant), during chemical or spectral sensitization (finish addenda) or just prior to the coating of an emulsion on a support (melt addenda). Generally, it would be desired, but not required, to use less of the water soluble alkynylamine if it is incorporated during chemical or spectral sensitization, or just prior to coating. Such amounts may vary from the amounts used when the alkynylamine is present during precipitation by as much as a factor of two or three.

It is preferred that the water soluble alkynylamines of the present invention be present during precipitation of the silver halide grains of the silver halide emulsion. The optimum levels of alkynylamine would depend upon the particular alkynylamine utilized, the particular stage of precipitation at which the alkynylamine is added, and upon the particular effect desired. For instance, in elements wherein compound A is present during precipitation of the outer 10 percent of each grain, it is desired to utilize levels less than 1.0 millimole per mole of silver. Ideally, levels less than 0.1 millimole per mole of silver are utilized.

As described, in a preferred embodiment of the present invention, the water soluble alkynylamines are added to the emulsion during silver halide precipitation. Specifically, it is preferred that the alkynylamines be added after about 60 percent of the silver halide has precipitated. It is even more preferred that the alkynylamines be added to the emulsion after about 90 percent of the silver halide has precipitated. In the above instances, alkynylamines are intended to be added until about 98 percent of the silver halide has precipitated, although it is contemplated to be within the scope of the invention that the alkynylamines be present during a banding (e.g. 20–70%) of each grain. Overall, it is desired that the alkynylamines be incorporated during the formation of at least 10 percent of the volume of the silver halide grains.

It is also preferred that the above compounds be added to emulsions comprised of predominantly silver iodobromide. Although it is specifically contemplated that the advantages of the invention would be present in emulsions containing silver halide grains of any type (silver bromide, chloride, or iodide, or mixtures thereof) or form (i.e. cubic, octahedral, dodecahedral, spherical or tabular), a silver iodide content of less than 30 molar percent is preferred. Even more preferred is an emulsion containing less than 10 molar percent of silver iodide, the remaining halide being accounted for by silver bromide and/or silver chloride.

As noted, the present invention may be practiced with any form (i.e. cubic, octahedral, dodecahedral, spherical or tabular) of silver halide grains. It is preferred, however, that the present invention be practiced with tabular grains having an aspect ratio greater than 2:1, preferably at least 5:1, and optimally at least 7:1. Aspect ratio as used herein is understood to mean the ratio of the equivalent circular diameter of a grain to its thickness. The equivalent circular diameter of a grain is the diameter of a circle having an area equal to the projected area of the grain.

The photographic elements of the present invention may be simple single layer elements or multilayer, multicolor elements. Multicolor elements contain dye image-forming units sensitive to each of the three primary regions of the visible light spectrum. Each unit can be comprised of a single emulsion layer or of multiple emulsion layers sensitive to a given region of the spectrum. The layers of the element, including the layers of the image-forming units, can be arranged in various orders as known in the art.

A typical multicolor photographic element comprises a support bearing a cyan dye image-forming unit comprising at least one red-sensitive silver halide emulsion layer having associated therewith at least one cyan dye-forming coupler; a magenta image-forming unit comprising at least one green-sensitive silver halide emulsion layer having associated therewith at least one magenta dye-forming coupler; and a yellow dye image-forming unit comprising at least one blue-sensitive silver halide emulsion layer having associated therewith at least one yellow dye-forming coupler. The element may contain additional layers, such as filter layers, interlayers, overcoat layers, subbing layers, and the like.

In accordance with a particularly preferred aspect of the present invention, the water soluble alkynylamine compounds are utilized in the yellow dye-forming blue sensitive layer, preferably of a reversal film.

The photographic elements may also contain a transparent magnetic recording layer such as a layer containing magnetic particles on the underside of a transparent support, as in U.S. Pat. Nos. 4,279,945 and 4,302,523. Typically, the element will have a total thickness (excluding the support) of from about 5 to about 30 microns.

In the following discussion of suitable materials for use in the elements of this invention, reference will be made to *Research Disclosure,* December 1978, Item 17643, and *Research Disclosure,* December 1989, Item No. 308119, both published by Kenneth Mason Publications, Ltd., Dudley Annex, 12*a* North Street, Emsworth, Hampshire PO10 7DQ, ENGLAND, the disclosures of which are incorporated herein by reference. These publications will be identified hereafter by the term "Research Disclosure." A reference to a particular section in "Research Disclosure" corresponds to the appropriate section in each of the above-identified *Research Disclosures.* The elements of the invention can comprise emulsions and addenda described in these publications and publications referenced in these publications.

As noted above, the silver halide emulsions employed in the elements of this invention can be comprised of silver bromide, silver chloride, silver iodide, silver bromochloride, silver iodochloride, silver iodobromide, silver iodobromochloride or mixtures thereof. The emulsions can include silver halide grains of any conventional shape or size. Specifically, the emulsions can include coarse, medium or fine silver halide grains. High aspect ratio tabular grain emulsions are specifically contemplated, such as those disclosed by Wilgus et al. U.S. Pat. No. 4,434,226, Daubendiek et al. U.S. Pat. No. 4,414,310, Wey U.S. Pat. No. 4,399,215, Solberg et al. U.S. Pat. No. 4,433,048, Mignot U.S. Pat. No. 4,386,156, Evans et al. U.S. Pat. No. 4,504,570, Maskasky U.S. Pat. No. 4,400,463, Wey et al. U.S. Pat. No. 4,414,306, Maskasky U.S. Pat. Nos. 4,435,501 and 4,643,966 and Daubendiek et al. U.S. Pat. Nos. 4,672,027 and 4,693,964, all of which are incorporated herein by reference. Also specifically contemplated are those silver iodobromide grains with a higher molar proportion of iodide in the core of the grain than in the periphery of the grain, such as those described in British Reference No. 1,027,146; Japanese Reference No. 54/48,521; U.S. Pat. Nos. 4,379,837; 4,444,877; 4,665,012; 4,686,178; 4,565,778; 4,728,602; 4,668,614 and 4,636,461; and in European Reference No 264,954, all of which are incorporated herein by reference. The silver halide emulsions can be either monodisperse or polydisperse as precipitated. The grain size distribution of the emulsions can be controlled by silver halide grain separation techniques or by blending silver halide emulsions of differing grain sizes.

Dopants may be added to the emulsions. Examples of dopants include compounds of copper, thallium, lead, bismuth, cadmium and Group VIII noble metals. Other dopants include transition metal complexes as described in U.S. Pat. Nos. 4,981,781, 4,937,180, and 4,933,272.

The emulsions can be surface-sensitive emulsions, i.e., emulsions that form latent images primarily on the surface of the silver halide grains; or internal latent image-forming emulsions, i.e., emulsions that form latent images predominantly in the interior of the silver halide grains. The emulsions can be negative-working emulsions such as surface-sensitive emulsions or unfogged internal latent image-forming emulsions, but can also be direct-positive emulsions of the unfogged, internal latent image-forming type, which are positive-working when development is conducted with uniform light exposure or in the presence of a nucleating agent.

The silver halide emulsions can further be surface-sensitized, and noble metal (e.g., gold), middle chalcogen (e.g., sulfur, selenium, or tellurium) and reduction sensitizers, employed individually or in combination, are specifically contemplated. Typical chemical sensitizers are listed in *Research Disclosure,* Item 308119, cited above, Section III.

The silver halide emulsions can be spectrally sensitized with dyes from a variety of classes, including the polymethine dye class, which includes the cyanines, merocyanines, complex cyanines and merocyanines (i.e., tri-tetra-, and polynuclear cyanines and merocyanines), oxonols, hemioxonols, stryryls, merostyryls, and streptocyanines. Illustrative spectral sensitizing dyes are disclosed in *Research Disclosure,* Item 308119, cited above, Section IV.

Suitable vehicles for the emulsion layer and other layers of elements of this invention are described in *Research Disclosure,* Item 308119, Section IX and the publications cited therein.

The elements of this invention can include couplers as described in *Research Disclosure,* Section VII, paragraphs D, E, F, and G and the publications cited therein. The couplers can be incorporated as described in *Research Disclosure,* Section VII, paragraph C, and the publications cited therein. Also contemplated are elements which further include image modifying couplers as described in *Research Disclosure,* Item 308119, Section VII, paragraph F.

The photographic elements of this invention can contain brighteners (*Research Disclosure,* Section V), antifoggants and stabilizers such as mercaptoazoles (for example, 1-(3-ureidophenyl)-5-mercaptotetrazole), azolium salts (for example, 3-methylbenzothiazolium tetrafluoroborate), thiosulfonate salts (for example, p-toluene thiosulfonate potassium salt), tetraazaindenes (for example, 4-hydroxy-6-methyl1,3,3*a*,7-tetraazaindene), and those described in *Research Disclosure,* Section VI, antistain agents and image dye stabilizers (*Research Disclosure,* Section VII, paragraphs I and J), light absorbing and scattering materials (*Research Disclosure,* Section VIII), hardeners (*Research Disclosure,* Section X), polyalkyleneoxide and other surfactants as described in U.S. Pat. No. 5,236,817, coating aids (*Research Disclosure,* Section XI), plasticizers and lubricants (*Research Disclosure,* Section XII), antistatic agents (*Research Disclosure,* Section XIII), matting agents (*Research Disclosure,* Section XII and XVI) and development modifiers (*Research Disclosure,* Section XXI.

The photographic elements can be coated on a variety of supports as described in *Research Disclosure,* Section XVII and the references described therein.

The photographic elements of the invention can be exposed to actinic radiation, typically in the visible region of the spectrum, to form a latent image as described in *Research Disclosure,* Section XVIII, and then processed to form a visible dye image as described in *Research Disclosure,* Section XIX. Processing to form a visible dye image includes the step of contacting the element with a color developing agent to reduce developable silver halide and oxidize the color developing agent. Oxidized color developing agent in turn reacts with the coupler to yield a dye.

Preferred color developing agents are p-phenylenediamines. Especially preferred are 4-amino-3-methyl-N,N-diethylaniline hydrochloride, 4-amino-3-methyl-N-ethyl-N-(β-methanesulfonamidoethyl)-aniline sulfate hydrate, 4-amino-3-methyl-N-ethyl-N-(β-hydroxyethyl)-aniline sulfate, 4-amino-3-(β-methanesulfonamidoethyl)-N,N-diethylaniline hydrochloride, and 4-amino-N-ethyl-N-(β-methoxyethyl)-m-toluidine di-p-toluenesulfonic acid. With negative-working silver halide emulsions, the processing step described above provides a negative image. The described elements can be processed in the known C-41 color process as described in, for example, the British Journal of Photography Annual, 1988, pages 196–198. To provide a positive (or reversal) image, the color development step can be preceded by development with a non-chromogenic developing agent to develop exposed silver halide, but not form dye, and then uniformly fogging the element to render unexposed silver halide developable. Reversal processing of the element of the invention is preferably done in accordance with the known E6 process as described and referenced in *Research Disclosure* paragraph XIX. Alternatively, a direct positive emulsion can be employed to obtain a positive image.

Development is followed by the conventional steps of bleaching, fixing, or bleach-fixing, to remove silver or silver halide, washing, and drying.

It is expected that the present invention will also yield photographic elements that exhibit superior raw stock keeping ability and superior latent image stability. It is also believed that the present invention will yield photographic elements that exhibit an improved resistance to pressure induced desensitization relative to known emulsions exhibiting similar sensitivity.

The present invention also relates to a process comprising sensitizing the silver halide grains of a silver halide emulsion by adding to said grains, during or after precipitation, a photographically effective amount of an alkynylamine compound having the structure:

$$Y—NHCH_2C{\equiv}CR^3$$

wherein $R^3$ represents a hydrogen atom, aliphatic, carbocyclic, or heterocyclic group, which may be substituted or unsubstituted; and Y represents a nitrogen containing heterocyclic moiety having substituted thereon, a water solubilizing group.

A photographically effective amount is an amount necessary to achieve some photographic effect; e.g. the amount necessary to achieve increased sensitivity. An example of an amount of the alkynylamine that is effective to achieve increased sensitivity is between about 0.001 millimole per mole of silver and about 5.0 millimoles per mole of silver.

The present invention also relates to water soluble alkynylamine compounds, preferably of the formula:

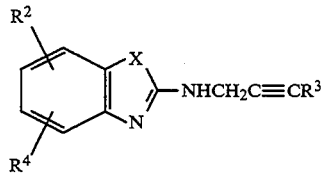

wherein X represents substituted or unsubstituted nitrogen; or oxygen, sulfur, or selenium; $R^3$ represents a hydrogen atom, aliphatic, carbocyclic, or heterocyclic group, which may be substituted or unsubstituted; $R^2$ and $R^4$ independently represent hydrogen, a halogen, a substituted or unsubstituted alkyl group, or a water solubilizing group, and wherein at least one of $R^2$ and $R^4$ is a water solubilizing group.

The following representative examples further illustrate this invention.

EXAMPLES

Compounds utilized in comparative examples may be prepared by any methods known in the art. Examples of such methods can be found in U.S. Pat. Nos. 4,451,557 and 4,378,426, both of which are incorporated herein by reference.

Synthesis of compounds utilized in accordance with the present invention may also be by any methods known in the art. Specific synthesis of compound II, utilized in the examples, is described below.

Compound II is equivalent to Compound A described above. Comparative compound I is identical to compound II but has a hydrogen in place of the water solubilizing group.

Preparation of 5-Methoxycarbonylbenzoxazol-2-thione

In a round bottom flask equipped with a mechanical stirrer, reflux condenser and drying tube were placed 2-amino-4-methoxycarbonylphenol (8,3 g, 0.05 mole), O-ethylxanthic acid potassium salt (8.8 g, 0.055 mole) and pyridine (125 mL). The mixture was stirred and heated at reflux for 2 hours and cooled to room temperature. The mixture was poured into ice and concentrated HCl (50 mL). The product was collected as a solid and washed thoroughly with water. The material was air dried to give 9.9 g (95%) of the 5-methoxycarbonylbenzoxazol-2-thione as a white powder, m.p. 218°-221° C.

Preparation of
2-Chloro-5-methoxycarbonylbenzoxazole

In a round bottom flask equipped with a magnetic stirrer, nitrogen inlet, reflux condenser and drying tube were placed 5-methoxycarbonylbenzoxazolthione (5.2 g, 0.025 mole), phosphorus pentachloride (5.2 g, 0,025 mole), and phosphorus oxychloride (40 mL). The reaction mixture was heated by an oil bath at 95°-100° C. for 4 hours. The reaction mixture was allowed to cool to room temperature and filtered. The filtrate was distilled with a short path distillation apparatus and the product was collected at 160°-163° C. at 29 mm Hg. The product solidified on standing to give a pale yellow solid, m.p. 104°-106° C. Anal Calcd. for C9H6ClNO3: C, 51.1; H, 2.9; N, 6.6; Cl, 16.8. Found: C, 50.7; H, 2.9; N, 6.6; Cl, 16.3

Preparation of
2-(2-butynylamino)-5-benzoxazolecarboxylic acid sodium salt

A mixture of 2-chloro,5-benzoxazolecarboxylic acid methyl ester (30 g, 0.14 mol), 2-butyne-1-amine p-toluenesulfonic acid salt (40 g, 0.16 mol), triethylamine (34 g) and acetonitrile (200 ml) were stirred together at room temperature under nitrogen for hours. The reaction was concentrated and the residue was partitioned between ethyl acetate and water. The organic layer was concentrated. The product 2-(2-butynylamino), 5-benzoxazolecarboxylic acid methyl ester (13 g, 0.053 mol) was treated with a 45% solution of potassium hydroxide (6.6 g, 0.05 mol), and 100 ml each of tetrahydrofuran, methanol and water. The reaction was stirred overnight at room temperature and concentrated. The residue was dissolved in ethanol, filtered and concentrated to give a white solid (Compound II).

Example 1

Emulsions were prepared in which water soluble alkynylamine compounds were added during silver halide precipitation.

Emulsion preparation

Tabular grain emulsions were precipitated and washed according to practices known in the art. The reactor was charged with a solution containing water, bone gel, sodium bromide, nitric acid, a polyoxyethylene (30%):poly-oxypropylene(70%) block copolymer of average molecular weight 1850 (Pluronic® L-43,(trademark of BASF corporation)), and 1,8-dihydroxy-3,6-dithiaoctaneo Nucleation of AgBr by double-jet addition of a soluble silver salt and a halide salt mixture with vigorous mixing occured at a temperature of 40° C., pH 2, and pAg 9.7 Following nucleation, temperature was increased to 70° C., additional peptizer was added, and reactor conditions were adjusted such that pH=5.5 and pAg 8.8. AgBrI was then precipitated by double-jet addition of soluble silver salt and mixed halide solutions. Excess salts were removed by practices known in the art.

Control Emulsion A $AgBr_{.97}I_{.03}$ was a tabular emulsion of median thickness 0.15 microns and equivalent circular diameter 2.7 microns. The iodide phase was uniformly distributed at 3 mole percent throughout the bulk of the crystal. Experimental emulsions B-E were prepared identically up to a fixed percentage Q of the total precipitated silver. At this point a solution of a sensitizing compound in a suitable solvent (methanol for compound I, water for compound II) was added to the reaction mixture, which was then held at quiescent conditions for 5 min. Double-jet precipitation of AgBr was then resumed for the remaining 100-Q percent of the total silver halide. Physical dimensions and grain morphology of chemically treated emulsions were indistinguishable from those of the control.

Each control/experimental group emulsion was subjected to an identical sensitization sequence determined to give optimum speed/fog performance for the control. Amounts in moles per mole of silver of principal ingredients in the order added were: $2.5\times10^{3}$ NaSCN, $1.2\times10^{-3}$ oxazolo- or thiazolo-cyanine sensitizing dye(s) or combinations thereof, $6.6\times10^{-6}$ gold from a labile gold reagent, $3.1\times10^{-5}$ sulfur from a labile sulfiding agent.

Chemical ripening was accomplished by the application of a thermal cycle determined to give optimal speed with minimal fog. A ten minute hold at 63° C. was used in these experiments and a stabilizer was added.

A mixture of the above-described sensitized emulsions with a colloidal dispersion of a yellow or cyan dye-forming coupler and additional gel was coated on a clear support with antihalation protection, in combination with a hardening agent and surfactants as required to obtain uniform spreading. Dry coatings received a stepped exposure on a Type I-b sensitometer having a light source of color temperature 5500K from which ultraviolet radiation was removed by means of a Wratten® (trademark of Eastman Kodak Company) Type 2B filter. Coatings were then processed through standard E-6 process to yield a reversal dye image.

In the tables below, relative reversal speeds were measured as the difference in exposure required to reduce the maximum dye density by 0.3. Relative negative speeds, when indicated, were measured at 0.15 above Dmin. Relative speed is expressed in units of 100*log(E) versus the control, arbitrarily fixed at 100 units. Fog is expressed as the percent of Dmin relative to Dmax in a standard 6 minute E6-rehalogenation process (or as Dmin for a 3.25 minute C-41 process).

Results from experiments utilizing water soluble alkynylamine compounds during precipitation are summarized in Table II. Amounts are expressed in moles of compound per mole of silver halide precipitated.

TABLE II

| | | | | | Reversal | |
|---|---|---|---|---|---|---|
| Emul | Cpd | Solv | Moles | Q | Fog % | Speed |
| A | none | none | none | — | 4% | 100 |
| B | I | MeOH | $1\times10^{-5}$ | 95% | 5% | 114 |
| C | I | MeOH | $5\times10^{-5}$ | 95% | 14% | 130 |
| D | I | MeOH | $5\times10^{-5}$ | 90% | 8% | 132 |

TABLE II-continued

| Emul | Cpd | Solv | Moles | Q | Reversal Fog % | Reversal Speed |
|---|---|---|---|---|---|---|
| E | II | water | $2 \times 10^{-4}$ | 90% | 5% | 131 |

In Table III, emulsions F and G were prepared similarly to emulsions A through E except that a major fraction (80%) of the total iodide was introduced by means of the bulk addition of an AgI seed emulsions at the point where 60% of total net silver was precipitated. The pAg at this point was 9.0. Final dimensions were 13×3.0 microns (thickness: equivalent circular diameter) and final net iodide was 3%. The results from these emulsions are summarized in Table III below.

TABLE III

| Emul | Cpd | Solv | Moles | Q | Reversal Fog % | Reversal Speed |
|---|---|---|---|---|---|---|
| F | none | none | none | — | 11% | 100 |
| G | II | water | $2 \times 10^{-4}$ | 91% | 11% | 114 |

In Table IV, emulsions H and K were essentially the same as emulsions F and G but the pAg was lowered to 7.7 beginning at the point of AgI introduction. In experimental emulsion J, a solution of compound II was delivered by metered addition of an aqueous solution at a constant rate over the specified percentage range of crystal growth following seed introduction. The results for both reversal and negative (C-41) processing are shown in Table IV.

TABLE IV

| Emul | Cpd | Solv | Moles | Q | Reversal Fog % | Reversal Speed | Negative Dmin | Negative Speed |
|---|---|---|---|---|---|---|---|---|
| H | none | Solv | none | — | 11% | 100 | .06 | 100 |
| J | n | none | $1.3 \times 10^{-4}$ | 67–83% | 14% | 119 | .07 | 125 |

In Table V, emulsions K and L compare to emulsions F and G, except that in L, compound II was added to the mixed alkali bromide and iodide salts used to grow the emulsion over the stated percentage range. Results are given in Table V.

TABLE V

| Emul | Cpd | Solv | Moles | Q | Reversal Fog % | Reversal Speed |
|---|---|---|---|---|---|---|
| K | none | none | none | — | 21% | 100 |
| L | II | water | $4 \times 10^{-4}$ | 64–85% | 22% | 109 |

The above results demonstrate that photographic elements according to the present invention, i.e. those treated during precipitation with a water soluble alkynylamine, exhibit significant speed increases relative to untreated emulsions. Furthermore, such speed increases are observed when the element is processed in reversal and negative processes, and the speed advantages are present regardless of when the alkynylamine was added.

It is also noteworthy that elements according to the present invention exhibit virtually no fog increases relative to the unsensitized control emulsion.

Example 2

Emulsions were prepared in which water soluble alkynylamine compounds were added during the chemical sensitization step.

Emulsion preparation

The emulsions for Example 2 were prepared identically to their counterparts in example 1 except that water soluble alkynylamine compounds were introduced only during chemical/spectral sensitization, as summarized in Tables VI and VII. Table VI demonstrates the invention in emulsions corresponding to emulsion A.

TABLE VI

| Emul | Cpd | Moles | Reversal Fog % | Reversal Speed |
|---|---|---|---|---|
| A | none | — | 5% | 100 |
| A | I | $5.2 \times 10^{-6}$ | 7% | 112 |
| A | II | $4.7 \times 10^{-6}$ | 5% | 114 |

Table VII demonstrates the invention in emulsions corresponding to emulsion H.

TABLE VII

| Emul | Cpd | Moles | Reversal Fog % | Reversal Speed | Negative Dmin | Negative Speed |
|---|---|---|---|---|---|---|
| H | none | — | 11% | 100 | .06 | 100 |
| H | 11 | $8 \times 10^{-6}$ | 11% | 114 | .07 | 121 |

The above results demonstrate that the advantages of the present invention can be achieved in both negative and reversal processing, and when the water soluble alkynylamine compounds are utilized as finish addenda as well as during precipitation. Furthermore, the speed/fog position of the present invention is an improvement over known elements containing similar but non-water soluble alkynylamines.

Example 3

Emulsions were prepared in which water soluble alkynylamine compounds were added after the heat treatment of the chemical sensitization step and just prior to coating:the emulsion on a support.

Emulsion Preparation

The emulsions contained silver chloride grains, a yellow-dye forming coupler, and gelatin. They were chemically sensitized with a Au(I) sensitizer and spectrally sensitized to blue light. The coupler was alpha-(4-(4-benzyloxy-phenyl-sulfonyl)phenoxy)-alpha(pivalyl)-2-chloro-5-(gamma-(2,4-di-t-amylphenoxy)butyramido)-acetanilide in di-nbutylphthalate coupler solvent (0.27 g/m$^2$). 0.104 g of 1-(3-acetamidophenyl)-5-mercaptotetrazole and 1.033 g of potassium bromide per silver mole were added. This mixture was coated on a resin coated paper support at 0.34 g Ag/m$^2$, 1.08 g coupler/m$^2$ and 1.51 g gel/m$^2$. A 1.076 g/m$^2$ gel overcoat was applied as a protective layer, along with the hardener bis-(vinylsulfonyl)methyl ether in an amount equivalent to 1.8% of total gelatin weight.

Coatings were given a 0.1 second exposure through a step tablet with a 3.0 log E range with a lamp having a color temperature of 3000K, intensity 2.95 log(lux), in order to simulate a color negative print exposure source. Further filtration was provided by a combination of magenta and cyan filters, a 0.3 neutral density filter, and a UV filter. The exposure required to increase reflection dye density to 1.0 density unit was taken as a measure of the sensitivity of the emulsion. Negative processing was performed in accordance with the known RA-4 process.

The results of Example 3 are shown below in Table VIII.

TABLE VIII

| Sample | Cpd | Solv | moles | Speed |
|---|---|---|---|---|
| 1 control | none | none | 0 | 164 |
| 2 comparison | I | MeOH | $1.1 \times 10^{-4}$ | 172 |
| 3 invention | II | water | $1.6 \times 10^{-4}$ | 168 |
| 4 invention | II | water | $4.8 \times 10^{-4}$ | 173 |
| 5 invention | II | water | $1.9 \times 10^{-3}$ | 178 |

The advantages of the present invention are observed when water soluble alkynylamine compounds are added to silver halide emulsions immediately prior to coating, i.e. as melt addenda. Such advantages are also present when water soluble alkynylamine compounds are used over a wide range of levels.

This invention has been described in detail with reference to preferred embodiments thereof, but it will be understood that variations and modifications can be effected within the spirit and scope of the invention.

What is claimed is:

1. A negative or reversal photographic element comprising a silver halide emulsion and an alkynylamine compound having the structure $$Y{-}NHCH_2C{\equiv}CR^3$$

wherein $R^3$ represents a hydrogen atom, aliphatic, carbocyclic, or heterocyclic group, which may be substituted or unsubstituted; and Y represents a nitrogen containing heterocyclic moiety having substituted thereon, a water solubilizing group.

2. The photographic element of claim 1 wherein the alkynylamine compound has the structure

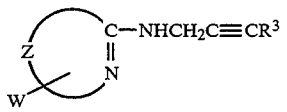

wherein Z represents atoms necessary to complete a five to nine-membered heterocyclic ring system;

W is a water solubilizing group; and $R^3$ is as defined in claim 1.

3. The photographic element of claim 1 wherein the alkynylamine compound has the structure

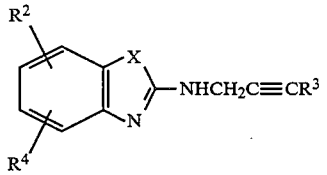

wherein X represents substituted or unsubstituted nitrogen; or oxygen, sulfur, or selenium; $R^3$ is as defined in claim 1; $R^2$ and $R^4$ independently represent hydrogen, a halogen, a substituted or unsubstituted alkyl or alkoxy group, or a water solubilizing group, and wherein at least one of $R^2$ and $R^4$ is a water solubilizing group.

4. The photographic element of claim 3 wherein the water solubilizing group is selected from the group consisting of carboxy, carboxyalkyl, sulfo, sulfoalkyl, phosphato, phosphatoalkyl, phosphono, phosphonoalkyl, carbonamido, sulfonamido, hydroxy, and the salts thereof.

5. The photographic element of claim 4 wherein $R_3$ is other than hydrogen.

6. The photographic element of claim 5 wherein $R_3$ is a methyl group.

7. The photographic element of claim 6 wherein X is oxygen.

8. The photographic element of claim 7 wherein the silver halide grains are comprised of silver bromide or silver iodobromide.

9. The photographic element of claim 8 wherein the silver halide grains are comprised of silver iodobromide.

10. The photographic element of claim 8 wherein the silver halide emulsion comprises silver halide tabular grains.

11. The photographic element of claim 1 wherein the alkynylamine compound is contained in the photographic element in an amount between about 0.001 mmole per mole of silver and about 5.0 mmoles per mole of silver.

12. The photographic element of claim 11 wherein the alkynylamine compound is contained in the photographic element in an amount between about 0.002 mmole per mole of silver and about 1.0 mmole per mole of silver.

13. The photographic element of claim 12 wherein the alkynylamine compound is contained in the photographic element in an amount between about 0.005 mmole per mole of silver and about 0.5 mmole per mole of silver.

14. The photographic element of claim 1 wherein the alkynylamine compound is selected from the group consisting of Compound A:

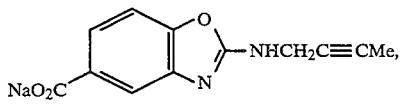

Compound B:

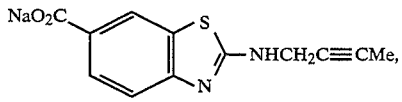

Compound C:

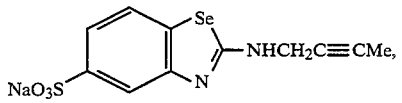

Compound D:

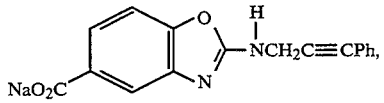

-continued

Compound E:

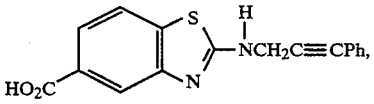

Compound F:

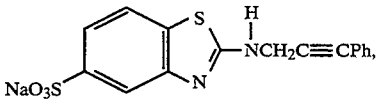

Compound G:

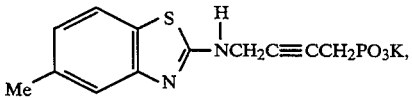

Compound H:

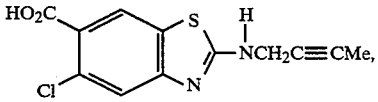

Compound I:

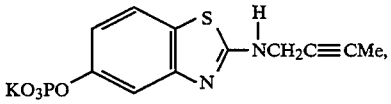

Compound J:

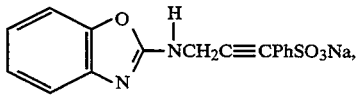

and

Compound K:

-continued

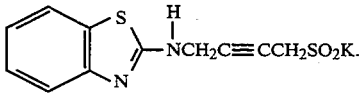

15. A process comprising sensitizing silver halide grains of a negative or reversal silver halide emulsion by adding to said grains, during or after precipitation, a photographically effective amount of an alkynylamine compound having the structure:

$$Y—NHCH_2C{\equiv}CR^3$$

wherein

R3 represents a hydrogen atom, aliphatic, carbocyclic, or heterocyclic group, which may be substituted or unsubstituted; and Y represents a nitrogen containing heterocyclic moiety having substituted thereon, a water solubilizing group.

16. A process according to claim 15 wherein the alkynylamine compound is in an amount between about 0.001 mmole per mole of silver and about 5 mmole per mole of silver.

17. A process according to claim 15 wherein the silver halide grains are precipitated in the presence of the alkynylamine compound.

18. A negative or reversal photographic element comprising a silver halide emulsion, said emulsion comprising a photographically effective amount of a water soluble alkynylamine having the structure $$Y—NHCH_2C{\equiv}CR^3$$

wherein $R^3$ represents a hydrogen atom, aliphatic, carbocyclic, or heterocyclic group, which may be substituted or unsubstituted; and Y represents a nitrogen containing heterocyclic moiety having substituted thereon, a water solubilizing group.

* * * * *